United States Patent [19]

Larger

[11] 4,454,902

[45] Jun. 19, 1984

[54] METHOD AND APPARATUS FOR SPLITTING LOGS

[76] Inventor: Nelson N. Larger, 425 Somerset Ave., Salisbury, Md. 21801

[21] Appl. No.: 370,995

[22] Filed: Apr. 22, 1982

[51] Int. Cl.[3] ..... B27L 7/00

[52] U.S. Cl. ..... 144/366; 144/193 R

[58] Field of Search ..... 144/3 K, 193 R, 366

[56] References Cited

FOREIGN PATENT DOCUMENTS

| | | | |
|---|---|---|---|
| 445237 | 2/1949 | Italy | 144/193 R |
| 459940 | 10/1950 | Italy | 144/193 R |
| 751628 | 7/1980 | U.S.S.R. | 144/193 R |

*Primary Examiner*—W. D. Bray

*Attorney, Agent, or Firm*—William E. Mouzavires

[57] ABSTRACT

Method and apparatus for splitting logs wherein one end of the log is progressively forced against a reciprocating wedge-like cutting head. The log is forced against the cutting edge of the head by a heavy wedge acting on the other end of the log to force it along its longitudinal dimension until the cutting head splits the log. The cutting head is reciprocated with a small stroke in the range of about one-half inch by means of a rotating eccentric cam shaft on which the splitting head is mounted. The cam shaft is powered by a small electric or gasoline motor through a drive train. The wedge is manipulated by hand between an adjustable stop and the end of the log. The log rests on an elongated horizontal frame between the wedge located at one end of the frame, and the cutting head located at the other end of the frame.

14 Claims, 5 Drawing Figures

METHOD AND APPARATUS FOR SPLITTING LOGS

BACKGROUND OF INVENTION

In recent times, energy conservation has spawned a new era of wood burning stoves and fireplace attachments for increasing heating efficiency. This, of course, has given rise to the need of split logs and has resulted in the increased use of mechanized log splitters. Conventional log splitters, in many cases, utilize heavy duty motors or hydraulic mechanisms to force a cutting head through the log or conversely, to force the log upon the cutting head. Also, with certain conventional log splitters, it is necessary to guide the log by hand against a cutting edge, thereby creating an inherently dangerous situation.

OBJECTS OF THE PRESENT INVENTION

It is an object of the present invention to provide novel method and apparatus for safe and efficient splitting of logs. Included herein is such a method and apparatus which requires relatively low energy consumption and but a single operator who is not exposed to fast-moving cutting wedges or other dangerous cutting heads or elements.

A further object of the present invention is to provide a novel apparatus for splitting logs in a safe and efficient manner and yet may be made with a relatively economical and durable construction that may be simply operated by a single person.

SUMMARY OF INVENTION

In accordance with the invention, a log is forced, preferably in a generally horizontal plane, along its longitudinal direction against a wedge-like cutting head which reciprocates at a low speed and with a very small stroke in the range of one-half inch. The log is so forced by a wedge which is guided in increments downwardly in a vertical plane while bearing against the rear end of the log to advance behind the log until the log is sufficiently advanced on the cutting head and split thereby. During operation, the log is intermittently retracted from the wedge by the cutting head during the return stroke thereof, allowing the wedge to move further downwardly to reengage the log and apply pressure thereto.

Apparatus embodying the present invention includes a generally horizontal frame for receiving the log between the reciprocable cutting head located at one end of the frame and the wedge located at the other end of the frame. A small motor, for example, a one horsepower electric motor or a three horsepower gasoline motor is used to reciprocate the cutting head through a drive train to a cam shaft on which the cutting head is suitably mounted. The wedge is manipulated by hand and guided in a vertical plane through the frame while bearing against the rear end of the log. Preferably, an adjustable stop is mounted in a preselected position at the end of the frame to receive the wedge and guide it in its downward travel.

DRAWINGS

Other objects and advantages of the present invention will become apparent from the following detailed description taken in conjunction with the attached drawings in which.

DETAILED DESCRIPTION

Figure 1:
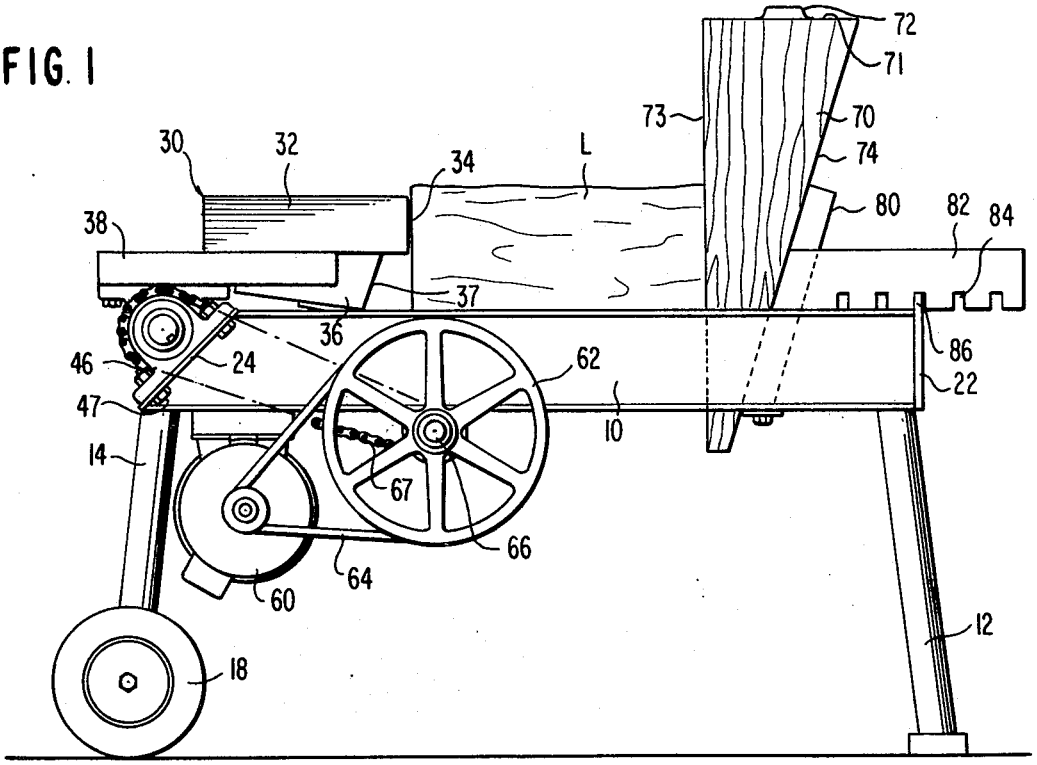
FIG. 1 is a side elevational view of apparatus embodying the invention.

Referring now to the drawings in detail, there is shown for illustrative purposes only, apparatus constituting a preferred embodiment of the present invention for carrying out the method of the present invention. The apparatus includes a main frame including a pair of elongated angle iron beams or channels 10 extending in a horizontal plane in side-by-side spaced parallel interrelationship. Frame members 10 are fixed to each other by means including cross pieces including front and rear pieces 24 and 22 respectively at opposite ends of the frame. The frame is supported from the ground surface by pairs of legs 12 and 14 suitably welded at opposite ends of the frame. Legs 12 are provided with feet 16 while legs 14 are braced by an axle 20 having wheels 18 mounted thereon for facilitating movement of the frame. The frame pieces are fabricated from suitable heavy-duty steel stock.

On the top of the frame at one end portion thereof is mounted a cutting head of suitable tool steel or alloy generally designated 30 including an upper portion 32 having a generally wedge-shape including opposite sides converging to a cutting edge 34. Cutting head further includes a lower wedge-like portion 36 fixed to the upper portion 32 but with its cutting edge 37 recessed inwardly from the cutting edge 34 of the upper portion for a purpose to become clear below.

Figure 2:
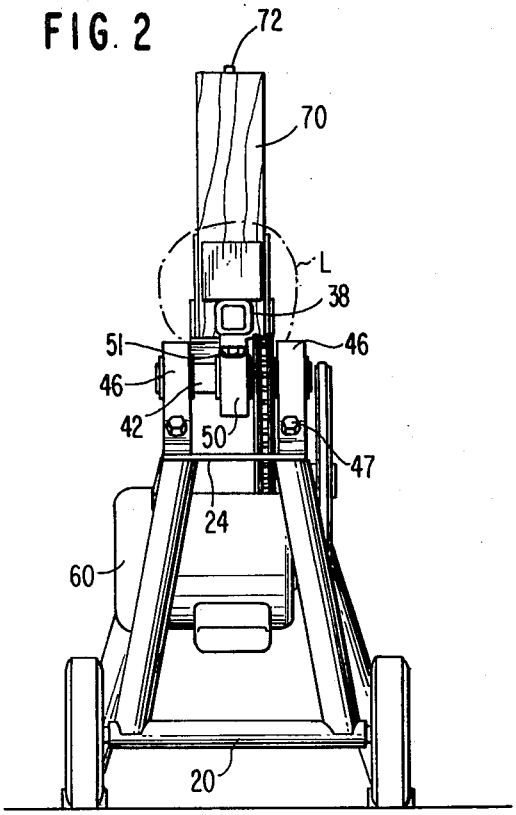
FIG. 2 is an end elevational view as seen from the left-hand side of FIG. 1.
Figure 3:
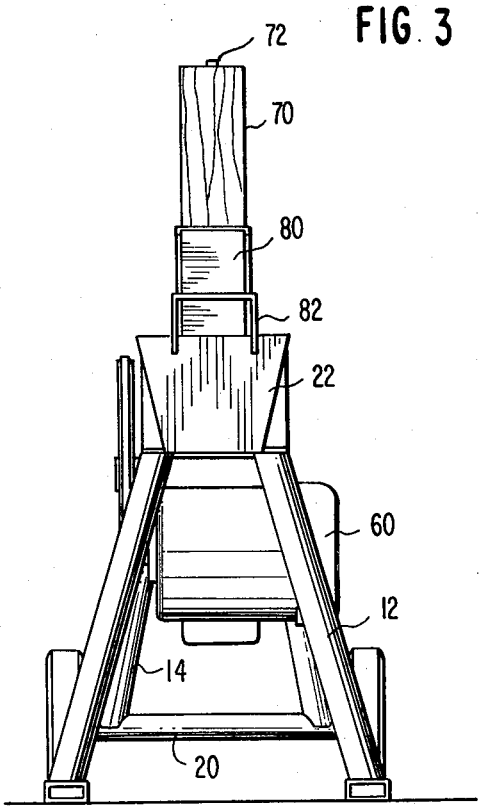
FIG. 3 is an end elevational view as seen from the right-hand side of FIG. 1.
Figure 4:
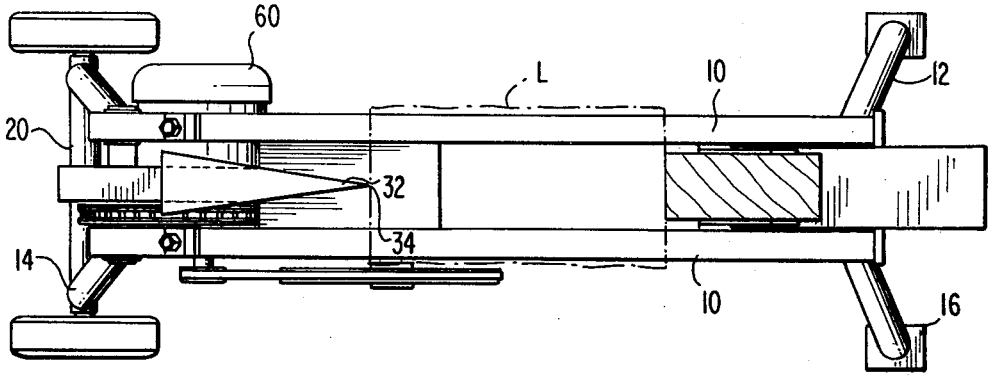
FIG. 4 is a top plan view of the apparatus.
Figure 5:
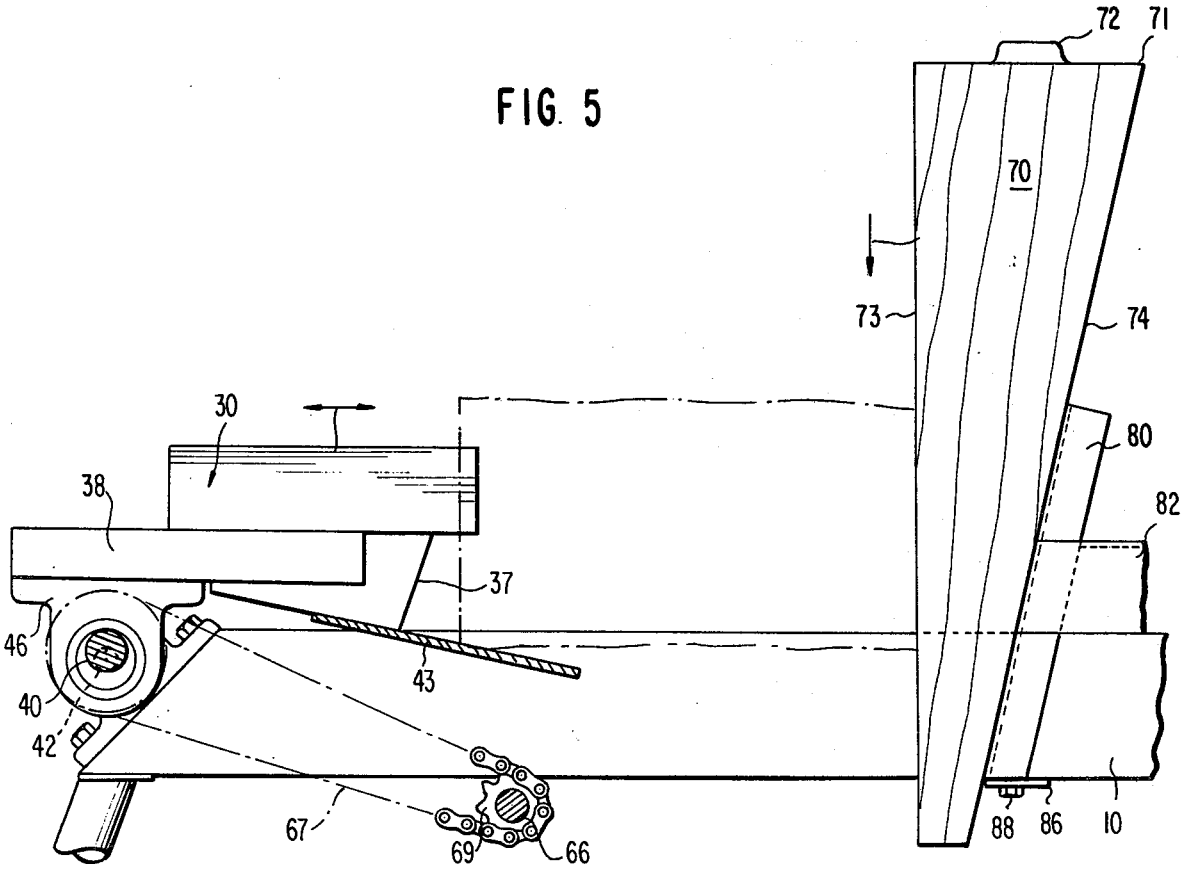
FIG. 5 is an enlarged side elevational view of portions of the apparatus.

The lower portion of the cutting head includes a mounting portion 38 which has a depending bearing 50 (see FIG. 2) fixed thereto by bolts 51. Bearing 50 mounts the cutting head about an eccentric cam 40 fixed on a shaft 42 as seen in FIG. 5. As seen in FIG. 2, shaft 42 has its opposite ends journaled in bearings 46 which are mounted by bolts 47 to the frame piece 24.

Rotation of shaft 42 causes the cutting head to reciprocate in the horizontal direction of the arrow (FIG. 5) due to its mounting on the cam 40. The parts are designed so that the reciprocating stroke of the cutting head is in the range of about one-fourth to three-quarters of an inch, preferably one-half of an inch. Any suitable support such as the plate 43 is fixed to the frame pieces 10 to support the bottom of the cutting head 30.

A simple, low horsepower motor 60 is suitably mounted to the underside of frame pieces 10 for driving the cutting head in reciprocation. Motor 60 may be a one horsepower electric motor or a three horsepower gasoline engine. In the specific embodiment shown, the output of motor 60 is operatively connected to a flywheel 62 by means of a pulley belt 64. Flywheel 62 is mounted on a shaft 66 journaled for rotation across the underside of frame 10 in any suitable manner. Shaft 66 has a sprocket 69 fixed thereto as shown in FIG. 5, and a drive chain 67 operatively interconnects the sprocket 69 and a sprocket on shaft 42 to transmit rotation to the latter upon energization of the motor 60.

At the end of the frame 10 opposite the cutting head is mounted a stop having a generally vertical but inclined front piece 80 including a flat surface adopted to engage a wedge 70 as will be described. The stop further includes a horizontal portion 82 which may be provided, for example, by an inverted U-channel fixed to inclined portion 80. The legs of portion 82 have a series of mounting notches 84 for selective receipt over a lug formed by the top edge 86 of frame piece 22 which projects above the top surface of frame members 10 as shown in FIG. 1. The bottom of inclined portion 80 in the specific embodiment shown, is provided with a cross piece 86 that may be secured by bolts 88 to the underside of frame 10 once the desired position of the stop has been selected through the use of the aforementioned notches 84.

In order to force a log L to be split against the cutting head, a heavy wedge 70 is employed having a horizontal top surface 71 provided with a handle 72, a front surface 73 extending at right angles to top surface 71, and a rear surface 74 inclined inwardly and downwardly from the top surface 71 at the same angle to the vertical as that of stop portion 80. Wedge 70 is formed from a suitable heavyweight, strong piece of stock preferably made of wood.

In carrying out the method of the present invention with the disclosed apparatus, the log L to be split is placed on the frame 10 in the position shown in FIG. 1. Assuming the stop surface 80 has been placed and secured into the proper position along the frame 10 commensurate with the length of log L, the wedge 70 is then placed behind the log L through the space between frame members 10 and with the rear inclined surface 74 against the inclined stop 80. The motor 60 is then energized to reciprocate the cutting head, and the operator grasping handle 72, applies downward pressure on the wedge 70. During return strokes of the cutting head 30, the log will be moved with and by the cutting head which, of course, has knifed into the log by virtue of the wedging force of wedge 70 and the cutting edge 34. As the log L is retracted by the cutting head 30 away from the wedge 70, the wedge 70 will drop further between the frame member 10 under the guidance of the latter and the stop 80 as well as the operator who may hold the wedge handle 72. As the wedge 70 drops further, it will of course also advance horizontally along the frame towards the log L to reengage the log L and continue the application of pressure to the log. The aforementioned action is successively repeated until the log has advanced sufficiently upon the cutting head 30 to cause the log to split. The split pieces may be easily removed laterally from opposite sides of the frame and the wedge may be withdrawn from the frame 10 for the next operation.

Due to its wedge-like shape and its cutting edge 34, the cutting head will of course easily enter the log L. However, due to the recessed lower cutting edge 37, portions of the log entering the recess below the top portion 32 of the cutting head will prevent the log from rising at its front end when it is pressured by the wedge 70 during operation. Moreover, because the wedge 70 will descend in increments under its own weight as described above, the operator need not apply any great pressure to the wedge 70 to move it downwardly during an operation. In other words, once the operation has started, the wedge 70 will be self-acting to maintain pressure on the log to force it upon the cutting head.

It will be noted that the operator's hands are at all times far removed from the cutting head 32 which, in any event, does not present any danger because it is moving at a relatively slow speed and reciprocating about one-half of an inch for each revolution of shaft 42.

The present invention thus provides a highly safe and yet efficient method and apparatus for splitting logs for home use or in commercial operations. Moreover, the apparatus of the invention is portable and requires relatively low energy consumption and is furthermore constructed with durable parts to withstand repeated and rugged use.

What is claimed is:

1. A method of splitting a log comprising the steps of progressively moving a wedge against one end of the log to force the other end of the log against a reciprocating wedge-like cutting head until the log has sufficiently advanced on to the cutting head and is split thereby along its longitudinal dimension, and wherein the wedge is moved downwardly while engaging the end of said log to apply pressure thereto, retracting said log from the wedge by means of said cutting head allowing the wedge to move further downwardly to reengage the end of the log to apply pressure thereto.

2. The method defined in claim 1 wherein the wedge is manipulated by hand.

3. The method defined in claim 2 wherein the cutting head is reciprocated in a horizontal plane with a stroke of about one-half inch.

4. The method defined in claim 1 wherein the cutting head is reciprocated in a horizontal plane with a stroke of about one-half inch.

5. Log splitting apparatus comprising in combination; a frame for supporting a log in a generally horizontal plane for movement along a generally horizontal path, a wedge-like cutting head, means mounting the cutting head on the frame for reciprocating movement in a generally horizontal plane, means including power means for reciprocating the cutting head, a wedge receivable on the frame for movement in a vertical plane for applying pressure to one end of a log to force the other end of the log against the cutting head,and means including a stop fixed relative to the frame for supporting and guiding the wedge during movement.

6. Apparatus defined in claim 5 further including means mounting said stop in one of several adjusted positions along the frame depending on the length of the log to be split.

7. Apparatus defined in claim 5 wherein said cutting head includes an upper portion having a cutting edge, and a lower portion recessed inwardly from the cutting edge.

8. The apparatus defined in claim 5 wherein said means for reciprocating said cutting head reciprocates said cutting head with a stroke in the range of one-half inch.

9. The apparatus defined in claim 8 wherein said power means includes a low horsepower motor having approximately one to three horsepower.

10. The apparatus defined in claim 5 wherein said power means includes a low horsepower motor having approximately one to three horsepower.

11. The apparatus defined in claim 8 wherein said means for reciprocating said cutting head includes a rotatable shaft having an eccentric cam, and means mounting said cutting head on said cam to be reciprocated thereby upon rotation of said shaft.

12. Apparatus defined in claim 5 wherein said means for reciprocating said cutting head includes a rotatable shaft having an eccentric cam, and means mounting said cutting head on said cam to be reciprocated thereby upon rotation of said shaft.

13. Apparatus defined in claim 12 wherein said means for reciprocating said cutting head further includes a low horsepower motor, a flywheel driven by said motor and transmission means between said flywheel and said shaft for rotating said shaft.

14. Apparatus defined in claim 13 wherein said motor has about one to three horsepower.

* * * * *